US006003171A

United States Patent [19]

Jones, Jr.

[11] Patent Number: 6,003,171

[45] Date of Patent: Dec. 21, 1999

[54] TWO-IN-ONE CHAIR LIFT AND TOILET SEAT

[76] Inventor: Johnny Charles Jones, Jr., 3240 Olive St. Apt. #45, Lemon Grove, Calif. 91945

[21] Appl. No.: 09/026,995

[22] Filed: Feb. 18, 1998

[51] Int. Cl.[6] ..... A47K 13/10

[52] U.S. Cl. ..... 4/667; 4/254

[58] Field of Search ..... 4/254, 667

[56] References Cited

U.S. PATENT DOCUMENTS 3,925,833 12/1975 Hunter ..... 4/667

4,399,572 8/1983 Johansson ..... 4/667 X

*Primary Examiner*—Robert M. Fetsuga

*Attorney, Agent, or Firm*—Frank Gilliam

[57] ABSTRACT

A combination wheelchair and seat lifting device for a disabled person. The wheelchair includes a pair of conventional wheelchair wheels centrally positioned and four small stabilizer wheels one at each corner of the chair support structure. The wheelchair includes a padded seat pivotally attached to a toilet seat. The toilet seat is manually pivoted from a use position to a stowed position. When used as a wheel chair, the padded seat is parallel with the chair support surface and when not in use as a wheel chair is pivoted to a position normal to the chair support surface. When pivoted the toilet seat is exposed for use. The toilet seat and pivotally attached padded seat are translatable vertically by a electric motor operating a cable system that is controlled by the user of the chair. When utilized as a wheel chair, the seats can be elevated to a suitable comfortable elevation selected by the user of the chair. When utilizing the chair as a toilet seat with the padded seat positioned normal to the chair support surface, the seats can be elevated to a selected elevation to receive the user on the toilet seat and then lowered with the user adjacent to the upper surface of a toilet bowl.

4 Claims, 4 Drawing Sheets

FIGURE 2 (FRONT)

FIGURE 3 (SIDE)

TWO-IN-ONE CHAIR LIFT AND TOILET SEAT

BACKGROUND OF THE INVENTION

FIELD OF THE INVENTION

The present invention, The Two-In-One Chair Lift and Toilet Seat is directed to patient lifting devices and portable electric hydraulic johnny aid. U.S. Pat. No. 4,399,572 issued Aug. 23, 1983, has a seat for patient lifting which is activated by human assistance to pump the handle which is located in the rear of the seat which patient is not able to activate. The carrier frame which is attached to a hoisting gear will limit the size of the patient to be lifted by the chair due to weight limitations. In that, the chair's specifications do not state the maximum weight allowed to successfully lift patient. Therefore, this chair requires the patient to be dependent upon assistance to activate the chair.

U.S. Pat. No. 3,925,833 issued Dec. 16, 1975, the portable electric hydraulic johnny aid is a staionary chair that allows patient to use a toilet bowl fixture by rotating a handle lever to raise and lower the chair over the toilet bowl. If the patient has arthritis or any other such ailments restricting hand movements, or perhaps weakend by their infirmity, would find it difficult to operate. This chair also must remain in one room, such as the bathroom for it would be very difficult to move from room to room.

This present invention, the Two-In-One Chair Lift and Toilet Seat device would allow the patient to use the Chair independently without the assistance of another person to raise and/or lower the Chair over the toilet bowl fixture. The patient may also use the Chair as a wheelchair to move from bedroom to bathroom and any other location in and around the home or residence. Whereas, the previous inventions require the chair to remain in one position as there are not wheels for movement or they require the patient to be totally dependent on another individual to activate the chair. None of the prior art references allow the patient to use the chair alone nor do they allow the patient to move the chair from room to room, thus requiring another chair for movement, such as a wheelchair.

BRIEF SUMMARY OF THE INVENTION

This invention relates to a conversion of a mobile chair lift to a bathroom toilet seat for the disabled or physically handicapped individual. The Two-In-One Chair Lift and Bathroom Toilet Seat assists the infirmed persons when seated to raise to a standing position and when standing to be lowered to a sitting position with the use of the attached hand-held electric switch. Therefore allowing the patient greater independence in using the Chair for sitting, standing and using the toilet seat to stradle a conventional toilet bowl.

The ease of operation allows the infirmed to be lowered to a toilet bowl and can be raised to a standing position as needed, such actions are accomplised without the use of a pumping, cranking or rotation device, which may be difficult for the infirmed persons to manage allowing possible accidents and may require human assistance as with previous inventions. The Two-In-One Chair Lift and Bathroom Toilet Seat allows for greater independence, using a high powered, yet safe, electric drive motor to raise and lower the Chair. The Chair may be used as a wheel chair in and around the home or residence. It may also be used by the bedside of a patient with limited motor skills.

As in prior inventions, there have been no satisfactory and safe means available for raising and lowering the infirmed persons onto and off toilet fixtures without a cranking, rotating or pumping action. This invention allows the infirmed persons to be seated securely and activate the Chair to the desired positions without jerking or sporadic motions. This invention further allows for smooth, consistent flowing motions with complete control of said movements by the patient allowing for greater independence as will be explained in the following descriptions and accompanying drawings.

DESCRIPTION OF THE VIEWS OF SEVERAL DRAWINGS

DETAILED DESCRIPTION OF THE INVENTION

Figure 1:
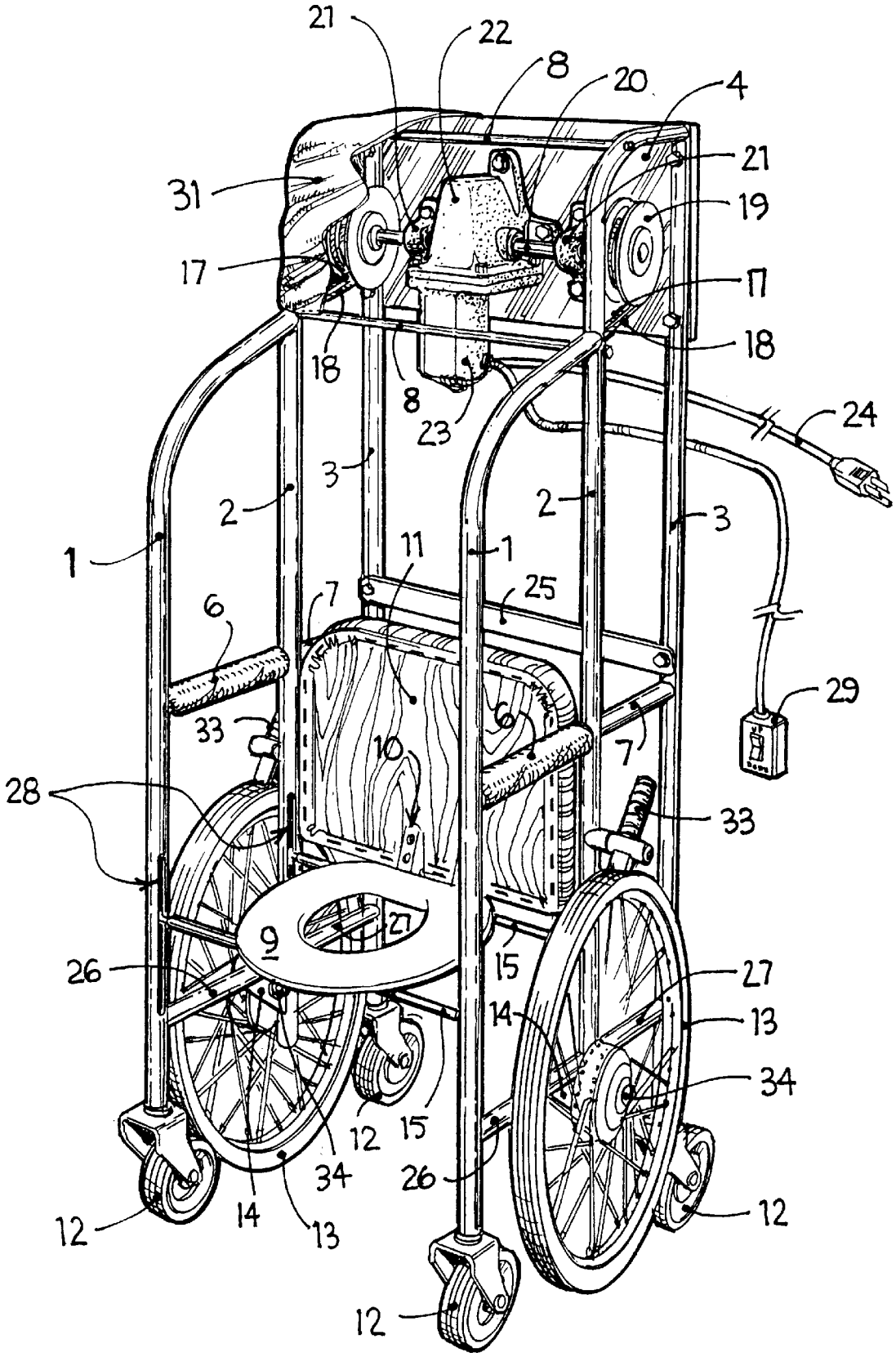
FIG. 1 is a perspective view of the combination Two-In-One Chair Lift and Toilet Seat.

Referring to FIG. 1, generally designates a U-shaped base frame with it's open end facing forward and shows the main bottom support of the embodiment of the invention illustrated in FIGS. 1–4. secured on and extending vertically upwardly from the base cross support bars, FIG. 1 shows a wheeled frame with the three main uprights; front (1), middle (2) and rear (3) frames. Each frame is supported by cross support bars (7), (25), (26), (27) to enable a sturdy and durable structure held together by tig-welding. The front frame upright (1) supports the front end connecting to the (2) middle frame upright. The 20 inch guide wheels (13) are attached to the main wheel gusset plate (14) which is tig-welded to the lower side front cross bar (26) on the middle frame (2) operating off the main drive wheel axle (34).

Extending from the base of the front (1) and rear (3) frames are the rubber caster wheels which are five inches in diameter and five and one-half inches in height. Further extending from the rear left and right frames (3) is the motor mount base (4) attached by one inch bolts two on each frame. The front flap of vinyl covering (31) is held by the upper and lower rods (8) of twenty-three inches long and three eighths of an inch in diameter to cover the motor mount base (4) and is held in the rear by snapping the three fasteners to the motor mount base (4). This is a removable cover or closure which may be detached or secured to the motor mount base, to provide access to the interior box or housing member, shown in FIGS. 1 and 2. The vinyl motor cover (31) safely houses the gear motor/transmision (22) and electric drive motor (23) and all of it's parts, housing the cable sleeve pulley (19). The front (1) and middle (2) frames in FIGS. 1 and 3 illustrates the slots/cut outs (38) for seat support cross bars allowing the seat to be raised or lowered as needed.

Figure 2:
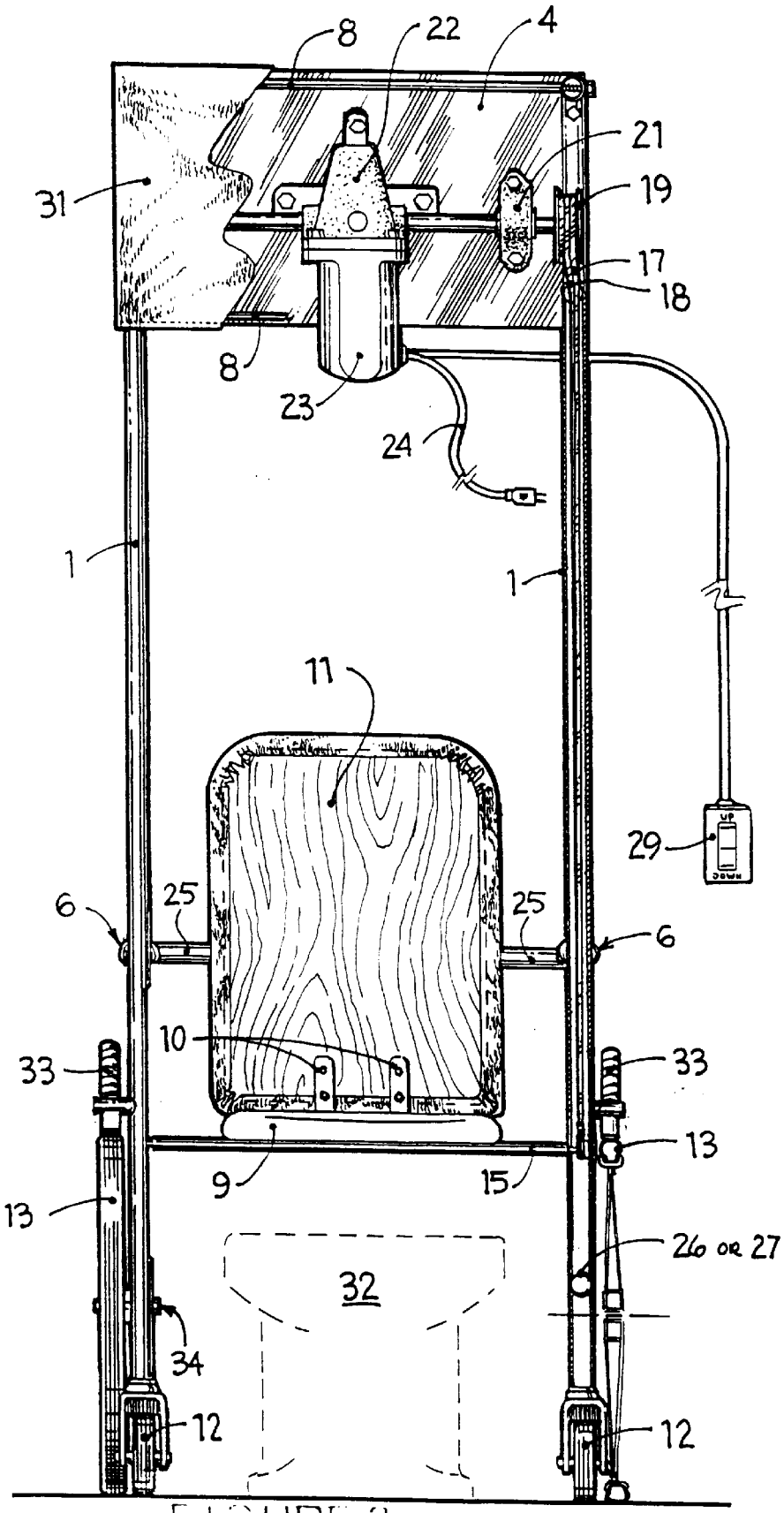
FIG. 2 is a front view of the Chair Lift and Toilet Seat as operated in a bathroom, placed in position over a standard toilet bowl.
Figure 3:
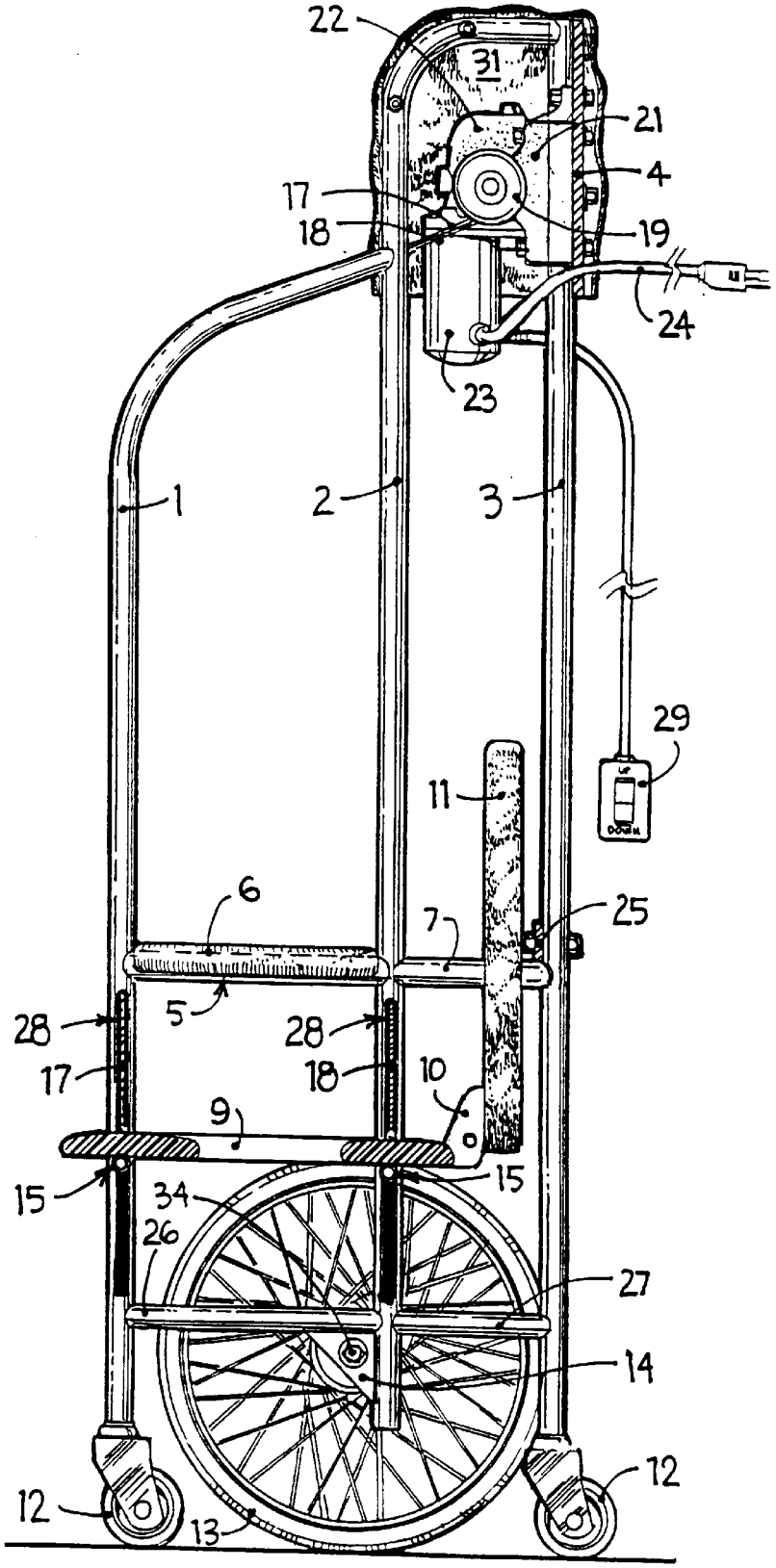
FIG. 3 is a side view of the Chair Lift and Toilet Seat in a lowered sitting position.
Figure 4:
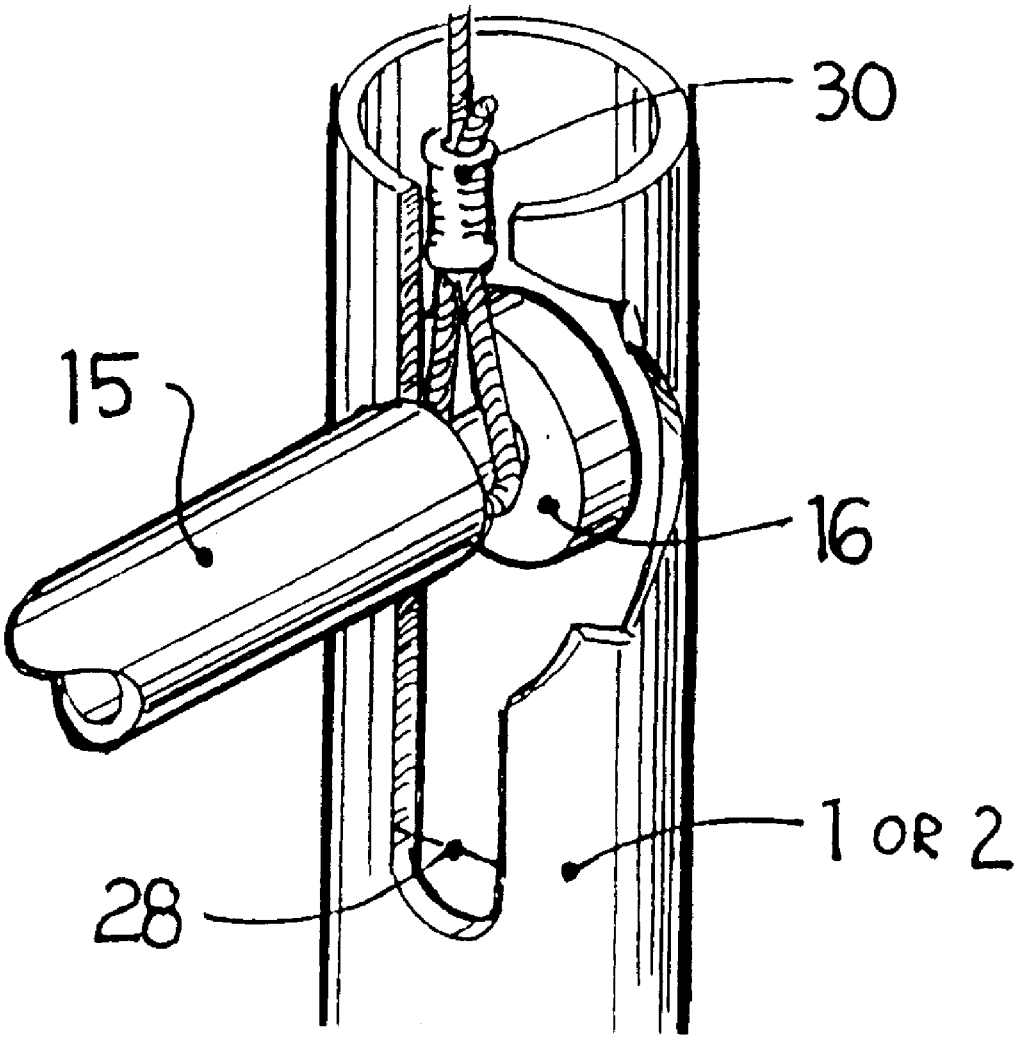
FIG. 4 is an enlarged detailed view of the section of FIG. 3 detailing the cable lift (30), seat support cross bar (15).

The Chair Lift Seat (9) is mounted on the two front and rear seat support cross bars (15) controlled by an electric switch (29) to raise and lower the seat, powered by the gear motor/transmission (22), as shown in FIGS. 2 and 3. Control of the toilet seat (9) movements is gained by using the electric hand-held switch. The padded Chair Seat (11) combination toilet seat cover (11) allows the chair to be used for sitting when not in use as a toilet seat. The padded hand rest (6) allows support while sitting and support for the patient while chair is in motion.

The right and left middle (2) frames each have holes fourteen inches from the top at the elbow on each side of the frame measuring three-eighths of an inch in diameter. The same holes are at the top of each rear middle frame (2), holding the vinyl cover (31) in place. From a standing position the chair is engaged by use of the electric hand-held control switch (29) allowing the patient to be lowered to a sitting position and further lowering to straddle a conventional toilet bowl. The hand-held electric switch activated allows the toilet seat (9) to lower to fourteen inches to straddle the toilet bowl (32) and twenty-two inches for a sitting position. Engaging the wheel brakes (33) to lock the wheels in place to prevent movement. The swage sleeve fastener cable (30) powered by the electric gearmotor (22) and electric drive motor (23). The front (1) and middle (2) frames house the pulley to raise the front frame lift cable (17) and middle frame lift cable (18) activated by the electric switch (29) to raise and lower the Chair/Toilet Seat. FIG. 2 illustrates the Chair Lift and Toilet Seat positioned over a standard toilet bowl. This invention allows the infirmed persons who may be capable of locomotion, but not able to assume a sitting posture from a standing position or are unable to assume a standing posture from a sitting position. The prime purpose is to allow such persons to be gently seated using the smooth operation of the hand-held electric switch and raised to a standing position using the same.

I claim:

1. A combination wheel and potty chair, comprising a vertical rectangular frame having support wheels for resting on a support surface;

a toilet seat translatably attached within said vertical rectangular frame for translation normal to said support surface;

a padded seat attached to said toilet seat and pivotable from a stowed position parallel to and covering said toilet seat to a stowed position to a position normal to said toilet seat exposing said toilet seat; and elevating means for translating said toilet seat and padded seat relative to said support surface.

2. The invention as defined in claim 1 wherein said support wheels comprise a small wheel at each corner of said rectangular frame and a pair of opposing larger diameter wheels centrally positioned on said rectangular frame, said larger diameter wheels rotatably connected on the outside surface thereof.

3. The invention as defined in claim 1 wherein said elevating means comprises a DC electric motor interconnected to said toilet seat via cables which when the DC motor operates in one rotational direction said toilet seat is elevated and when the DC motor is operated in the opposite rotational direction said toilet seat is lowered.

4. The invention as defined in claim 3 further comprising a control switch spaced from said DC motor for operating the rotation direction of said DC electric motor, said control switch is interconnected to said motor through an extended flexible connection.

* * * * *